United States Patent [19]

Pavely

[11] Patent Number: 4,674,649

[45] Date of Patent: Jun. 23, 1987

[54] METAL CAN END WITH PLASTICS CLOSURE

[75] Inventor: Andrew P. Pavely, Blunsdon, England

[73] Assignee: Metal Box p.l.c., Reading, England

[21] Appl. No.: 906,891

[22] Filed: Sep. 15, 1986

[30] Foreign Application Priority Data

Sep. 20, 1985 [GB] United Kingdom ..... 8523262

[51] Int. Cl.[4] ..... B65D 17/34

[52] U.S. Cl. ..... 220/271; 220/269; 220/270

[58] Field of Search ..... 220/269, 270, 271, 260

[56] References Cited

U.S. PATENT DOCUMENTS

| | | | |
|---|---|---|---|
| 3,756,448 | 9/1973 | Moller et al. | 220/271 |
| 4,391,385 | 7/1983 | Rausing | 220/269 |
| 4,572,398 | 2/1986 | Juty | 220/271 |
| 4,577,777 | 3/1986 | Brochman | 220/271 |

*Primary Examiner*—George T. Hall

*Attorney, Agent, or Firm*—Diller, Ramik & Wight

[57] ABSTRACT

A metal can end with a tear-open plastics closure in which the closure has a plug part fitting into an aperture in the can end, a rim surrounding the plug part, and a pull tab, wherein a groove extends across the plug part and aligned grooves or interruptions extend across the rim to provide a hinge line allowing the tab and the adjacent portion of the plug part to pivot upwardly to provide venting of the can in a first stage of opening before full opening of the closure in a second stage. The closure is of the kind which is moulded on to the can end so as to totally enclose a downturned flange around the periphery of the aperture, and to be capable of being sheared against the flange on opening, and the residual thickness of the plastics material below the flange is greater in the main portion than in the vent portion of the closure to provide a temporary arrest after venting. The plug part is stiffer than the metal of the can end so that doming of the can end under internal pressure is concentrated in the metal and the pull tab extends at an angle to the can end surface, rendering it easier to grasp for opening the aperture. A second hinge line may be provided at the far end of the closure, with a further increase in residual thickness, so that the closure can be retained on the can end while being hinged out of the way for pouring.

7 Claims, 11 Drawing Figures

METAL CAN END WITH PLASTICS CLOSURE

BACKGROUND OF THE INVENTION

1. Field of the Invention

This invention relates to metal can ends of the kind having an aperture closed by a tear-open plastics closure with a laterally extending pull tab for opening the aperture, in particular for cans intended to contain liquids under internal pressure, such as carbonated beverages.

2. Description of the Prior Art

In known arrangements, where a single large aperture in the metal can end is provided with a closure of uniform cross-section, it has been found that, once the closure has been pulled out of one end of the aperture, the closure comes out quickly and uncontrollably, with an objectionably loud noise and risk of spillage of the can contents. It is known to provide two apertures, namely a vent aperture and a pouring aperture, which are opened in sequence to reduce noise and risk of spillage, but this arrangement involves additional complications in the manufacture of the can ends.

SUMMARY OF THE INVENTION

It is an object of the invention to provide a single-aperture can end with a closure which can be opened in a controlled manner with reduced noise and risk of spillage.

According to the present invention, there is provided a metal can end with an aperture surrounded by a downturned flange formed in the metal of the can end and closed by a tear-open plastics closure, said closure having a plug part fitting into the aperture, a rim surrounding the plug part and overlying the metal of the can end around the aperture, and a laterally extending tab moulded as an integral part of the closure, the closure being moulded on to the can end so as to enclose the flange totally but to be capable of being opened by being sheared against the flange when the tab is pulled up, wherein the closure is formed with a groove extending across the plug part of the closure transversely to the length of the tab so as to form a hinge line allowing the tab and the adjacent portion of the plug part to pivot upwardly in relation to the remainder of the plug part, and the rim is reduced in thickness or interrupted in line with the groove so as not to afford substantial resistance to the hinging action, thus permitting venting of the can before full opening of the closure, and wherein the residual thickness of the plastics material below the flange is greater in the portion of the closure on the far side of the hinge line from the tab than in the portion adjacent to the tab, so as to cause a temporary arrest in the shearing action to allow time for venting before full opening of the closure. In effect, this construction results in a two-stage opening process, the first stage involving venting of the can through a relatively small part of the aperture, followed by a temporary arrest, and the second stage involving full opening of the aperture, so that noise and risk of spillage during the opening process are minimised. The greater residual thickness of the plastics material below the flange in the portion remote from the tab provides increased security against leakage due to creep of the plastics material when the can is stored under internal pressure.

Preferably the plug part of the closure, at least in its portion remote from the pull tab, has a higher resistance to bending than the metal of the can end, so that, when the can end is domed under internal pressure in the can, the said portion of the closure stiffens the part of the can end around it and the doming takes place principally in the remaining part of the can end. The laterally extending tab accordingly extends at an angle to the adjacent domed surface of the can end. The extremity of the tab is thus spaced from the can end and is easier to grasp for pulling it up to open the aperture. The plug part bends about the hinge, but the portion of the plug part immediately adjacent to the pull tab remains substantially unbent so that the pull tab extends away from the adjacent domed surface of the can end.

The desired resistance to bending of the plug part can be achieved by making it of appropriate thickness.

If a relatively stiff plastics material were used for the closure, and the rim were of uniform thickness, the stiffness of the plastics material might have the result that pulling up the tab would cause the closure as a whole to bend in a wide arc rather than allowing the portion adjacent the tab to pivot about the hinge line, with consequent unintentional full opening of the closure in the first stage of opening. It is for this reason that the rim is either reduced in thickness in line with the groove so as not to afford substantial resistance to the hinging action or is interrupted in line with the groove so as not to resist the hinging action at all. The use of a plug part with a relatively high resistance to bending also assists in preventing bending of the closure as a whole and unintentional full opening in the first stage.

In the case where the aperture and the plug part of the closure are elongated with parallel sides and rounded ends, the tab preferably extends laterally from one rounded end of the plug part, the groove extending across the plug part between the rounded end adjacent to the tab and the parallel-sided portion of the plug part. The groove is preferably of V section and of a depth substantially equal to half the thickness of the plug part of the closure.

In a modification, a second groove extends transversely across the plug part between the parallel-sided portion and the rounded end reaote from the connection to the tab, and the rim of the closure is reduced in thickness or interrupted in line with the second groove, to provide a second hinge line, and the residual thickness of the plastics material below the flange in the rounded end remote from the tab is greater than in the parallel-sided portion and is great enough to make shearing difficult, so that the closure can remain attached to the can end while being hinged out of the way about the second hinge line.

The invention also resides in a metal can having an end as defined above.

DETAILED DESCRIPTION OF THE INVENTION

Figure 1:
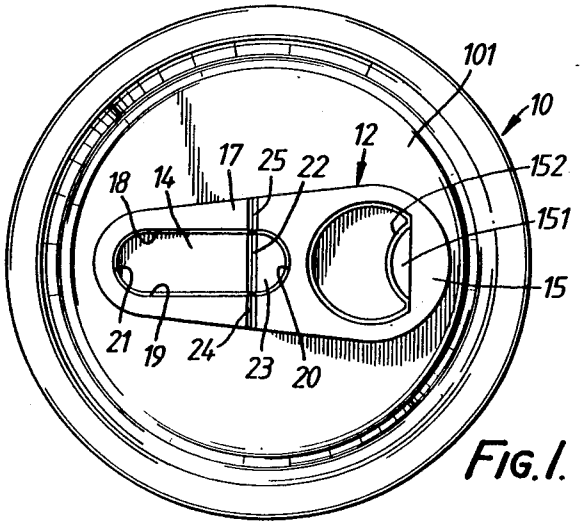
FIG. 1 is a plan view of a metal can end fitted with a plastics closure, in accordance with the invention.

As shown in FIGS. 1 to 4, a metal can end 10 is formed with an aperture 11 (FIG. 4) closed by a plastics closure 12. The closure 12 has a plug part 14 fitting into the aperture 11 and a laterally extending ring-shaped pull tab 15 moulded as an integral part of the closure. The aperture 11 is surrounded by a downturned flange 16 formed in the metal of the can end 10 and the closure is moulded on to the can end so as to enclose the flange 16 totally and to have an internal rim 171 which lies against the lower surface of the can end 10. The closure is capable of being opened by being sheared against the flat end 161 of the flange 16 when the tab 15 is pulled up. The closure 10 also has a upper lateral rim 17 which surrounds the plug part 14 and lies against the upper surface of the can end 10. As best seen in FIG. 1, the plug part 14 of the closure (and of course the aperture 11 which it fits into) is of elongated shape, having parallel sides 18,19 and rounded ends 20,21.

The ring-shaped pull tab 15 is provided with a segmental tongue 151 inside the ring to facilitate engagement by a finger of a person wishing to open the closure and with a thin fin 152 of the plastics material extending all round the inside of the ring to cushion the grip for the operator's finger.

The upper surface 141 of the plug portion 14 is recessed below the level of the surrounding rim 17 so as to lie substantially in the plane of the central panel 101 of the can end. A groove 22 is formed in the closure, extending across the upper surface 141 of the plug part 14 transversely to the length of the closure. The groove 22 extends across the plug part 14 between the rounded end 20 adjacent to the tab 15 and the parallel sided portion of the plug part and forms a hinge line allowing the tab 15 and the adjacent portion 23 of the plug part to pivot upwardly in relation to the remainder of the plug part, thus permitting venting of the can in a first stage of the opening process, as shown in FIG. 4, before full opening of the closure.

Figure 2:
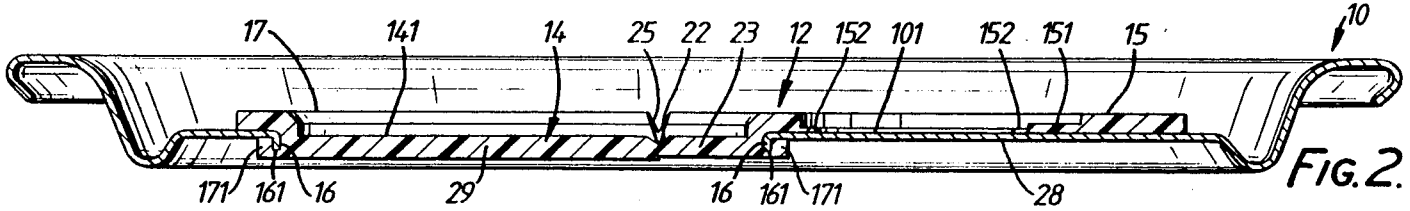
FIG. 2 is a cross-sectional view to a larger scale of the can end of FIG. 1.
Figure 3:
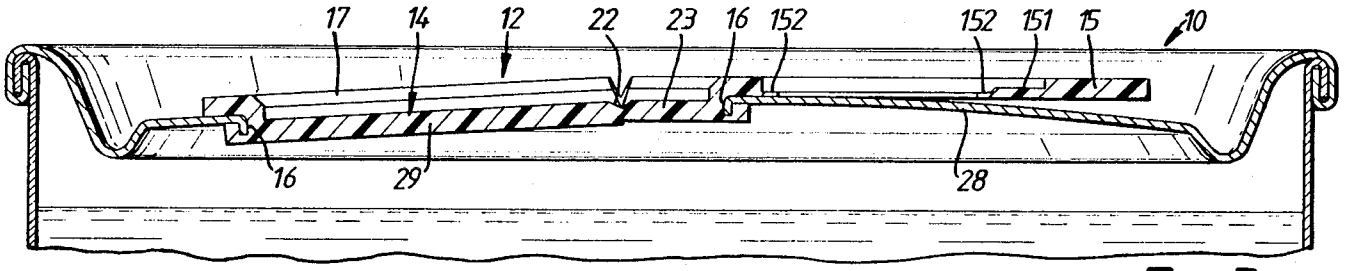
FIG. 3 is a view similar to FIG. 2 showing the can end domed under internal pressure in the can.

The groove 22 is of V section, as shown most clearly in FIGS. 2 and 3 and is of a depth substantially equal to half the thickness of the plug part 14.

In order that the rim 17 should not afford any substantial resistance to the folding of the portion 23 of the plug part 14 in relation to the remainder of the closure, particularly where a stiff plastics material such as nylon is used, the rim 17 is also reduced in thickness by means of grooves 24,25 in line with the groove 22 in the plug part and extending more than half way through the thickness of the rim 17. The reduction in thickness may be such that the residual material at the bottom of grooves 24,25 breaks when the portion 23 is folded up.

Figure 4:
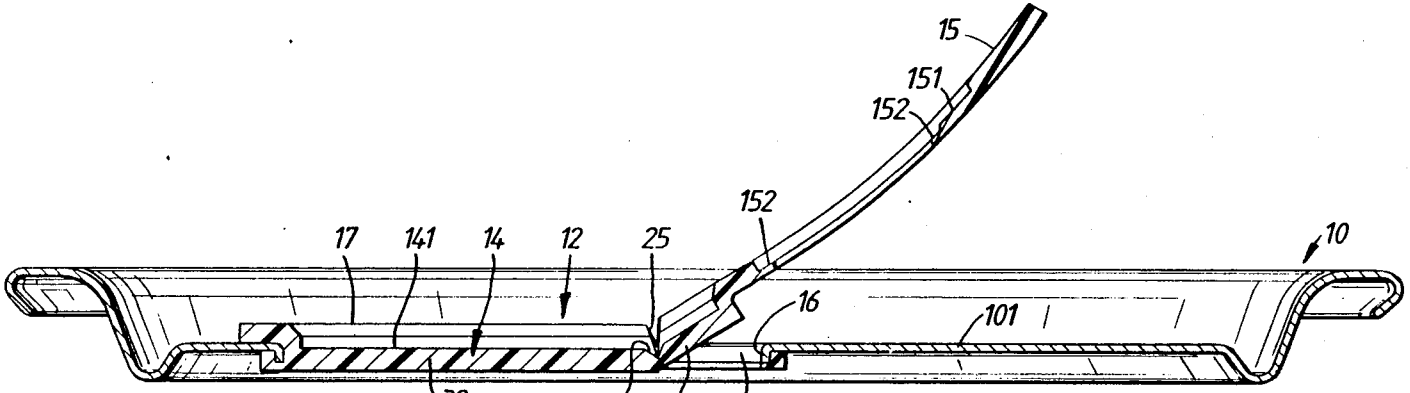
FIG. 4 is a view similar to FIG. 2 showing the first stage of the opening process.

Furthermore, as seen in FIGS. 2 to 4, the thickness of the plug part 14 of the closure is reduced in the portion 23 adjacent to the tab 15 so that the residual thickness of the plastics material below the flat end 161 of the flange 16 is greater in the portion 29 of the closure on the far side of the groove 22 from the pull tab 15 than it is in the portion 23 adjacent to the tab. This greater residual thickness is designed to cause a temporary arrest in the shearing action after the can has been vented by opening of the portion 23 of the closure as shown in FIG. 4. Further opening of the main part of the closure involves shearing down the parallel sides 18,19 of the plug part 14, which requires only a little more effort despite the greater residual thickness below the flange 16, but the discontinuity of effort reduces the danger that the internal pressure in the can might cause the shearing action to continue down the sides 18,19 and in effect blow the closure off the can end.

The internal pressure in the filled can will cause the can end to assume a domed shape, as shown in FIG. 3.

If the plug part 14 were of relatively thin material with a lower resistance to bending than the metal of the can end, the doming of the can end under internal pressure would take place predominantly around the aperture 11, and the plug part 14 would be subjected to substantial bending, whereas the part 28 of the metal can end under the pull tab 15 would not be substantially bent. As a result, the pull tab 15 would lie against the metal can end surface in spite of the doming and could be difficult to grasp, especially as the moulding process tends to form the pull tab 15 with side surfaces inclined to the surface of the can end. In the case of the can end shown in FIGS. 1 to 4, the plug part 14 is of substantial thickness and has a higher resistance to bending than the metal of the can end 10. When the can end is domed under internal pressure as shown in FIG. 3, the plug part 14 is accordingly not substantially bent except along the hinge formed by the groove 22. In particular, it is not bent in the portion 29 remote from the pull tab 15 and it stiffens the part of the can end around this portion 29. On the other hand, the part 28 of the metal can end under the pull tab 15 is substantially domed, because the additional resistance to bending imparted to the metal adjacent to the aperture 11 by the thick plug part 14 tends to concentrate the doming about the centre of the can end and the line of the hinge. As a result, the pull tab 15 extends at an angle to the adjacent surface of the can end and is much easier to grasp for opening of the aperture, as can be seen from FIG. 3.

It will be appreciated that it is particularly important that the portion 29 of the plug part 14 has a high resistance to bending. The fact that this portion 29 is of greater thickness than the remainder of the plug part 14 is therefore doubly advantageous. Furthermore, the greater thickness of the portion 29 and the consequent increased residual thickness of the plastics material below the flange 16 at the end of the closure remote from the tab 15 provides additional security against leakage, which might otherwise occur as a result of creep of the plastics material when the can is stored under internal pressure.

When the can end is not subjected to the internal pressure, its central panel is flat, not domed, and the pull tab 15 lies closely against the part 28 of the can end as shown in FIG. 2, which is advantageous for stacking can ends before use as it minimizes the space required.

Figure 5:
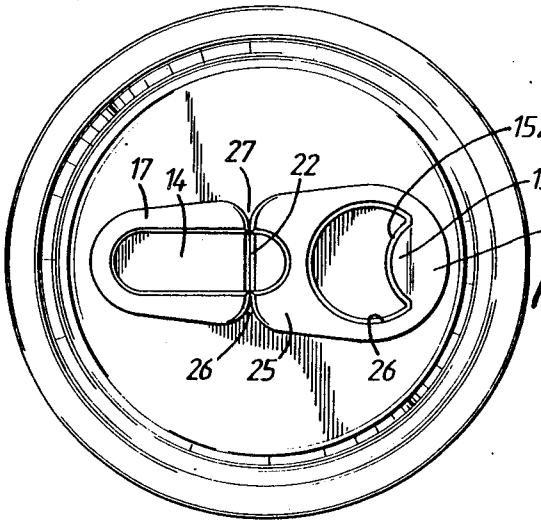
FIG. 5 is a plan view similar to FIG. 1 of a second embodiment of the invention.
Figure 6:
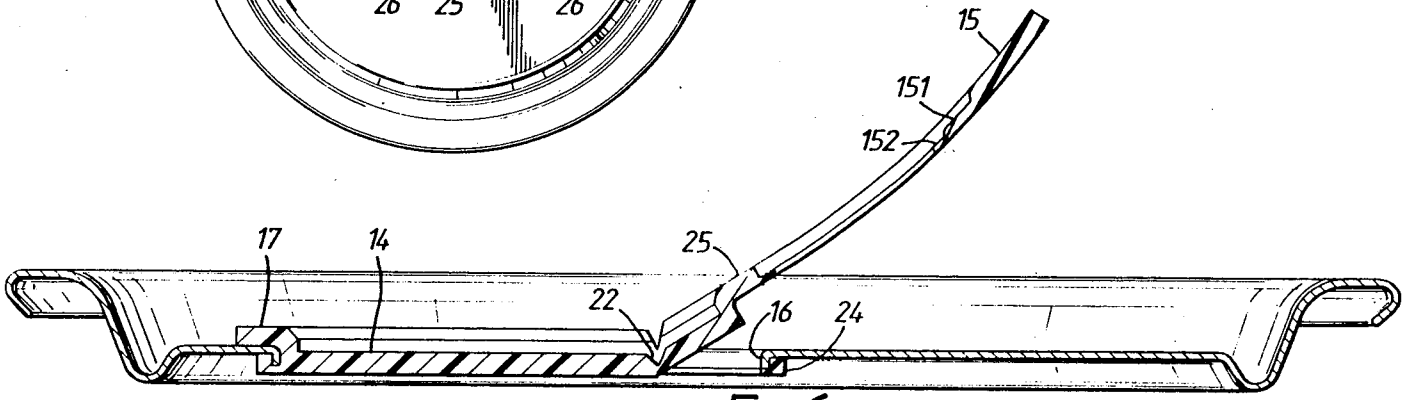
FIG. 6 is a cross-sectional view similar to FIG. 4 illustrating the first stage of the opening of the closure of FIG. 5.
Figure 9:
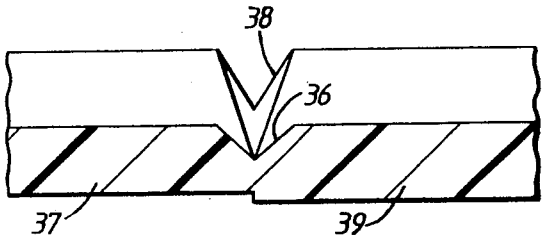
FIG. 9 is a detail cross-sectional view to a larger scale.
Figure 7:
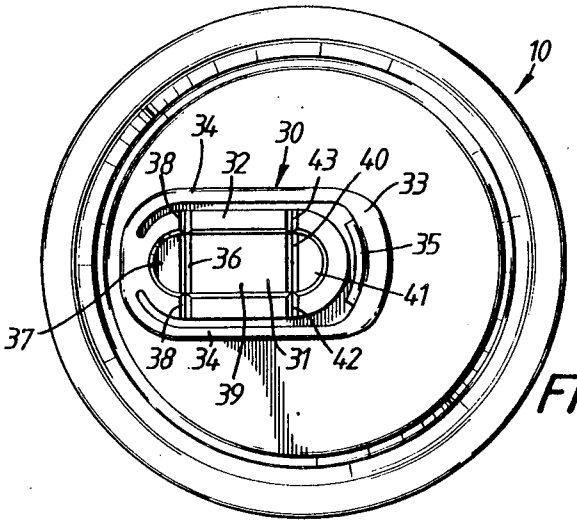
FIG. 7 is a plan view similar to FIGS. 1 and 5 of a third embodiment of the invention.
Figure 8:
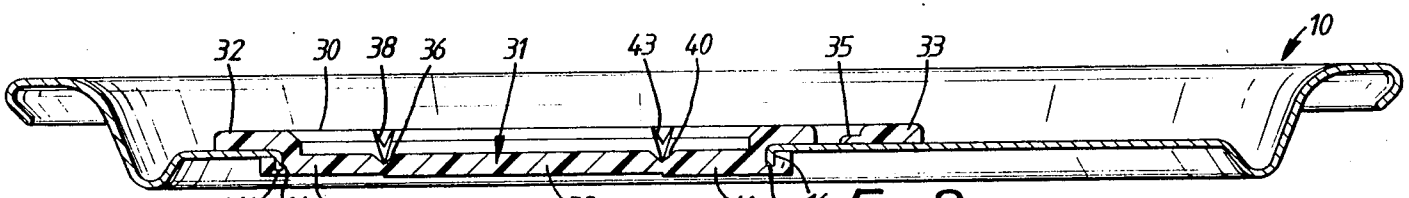
FIG. 8 is a cross-sectional view similar to FIG. 2 of the third embodiment.

In the modification illustrated in FIGS. 5 and 6, the rim 17 is not merely provided with grooves 24,25, but is cut away or interrupted at 26,27 in line with the groove 22, so as not to provide any resistance to the hinging action illustrated in FIG. 6. In all other respects, this embodiment of the invention is similar to that of FIGS. 1 to 4.

In the third embodiment illustrated in FIGS. 7 to 11, the can end 10, aperture 11 and flange 16 are the same as those shown in the preceding Figures. The closure 30 comprises a plug part 31 with a lateral rim 32 moulded into the can end 10 as before so as to enclose the flange 16, as before, but the pull tab 33 is in the form of a loop having side pieces or arms 34 embracing the rim 32 and joined to the rim at the left-hand end of the closure, as seen in the drawings. A finger grip 35 is provided on the right-hand end of the pull tab 33. A groove 36 corresponding to groove 22 of FIGS. 1 to 6 extends across the plug part 31 of the closure between its rounded left-hand end 37 which forms the vent portion, and the main parallel-sided portion 39. Grooves 38 in the rim 32 are aligned with the groove 36, and the thickness of the main parallel-sided portion 39 of the plug part is greater than the vent portion 37 so as to increase the residual thickness of the plastics material below the flat end 161 of the flange 16 in the portion 39 and thereby to provide a temporary arrest in the shearing action after venting, as in the previously described embodiments.

Figure 10:
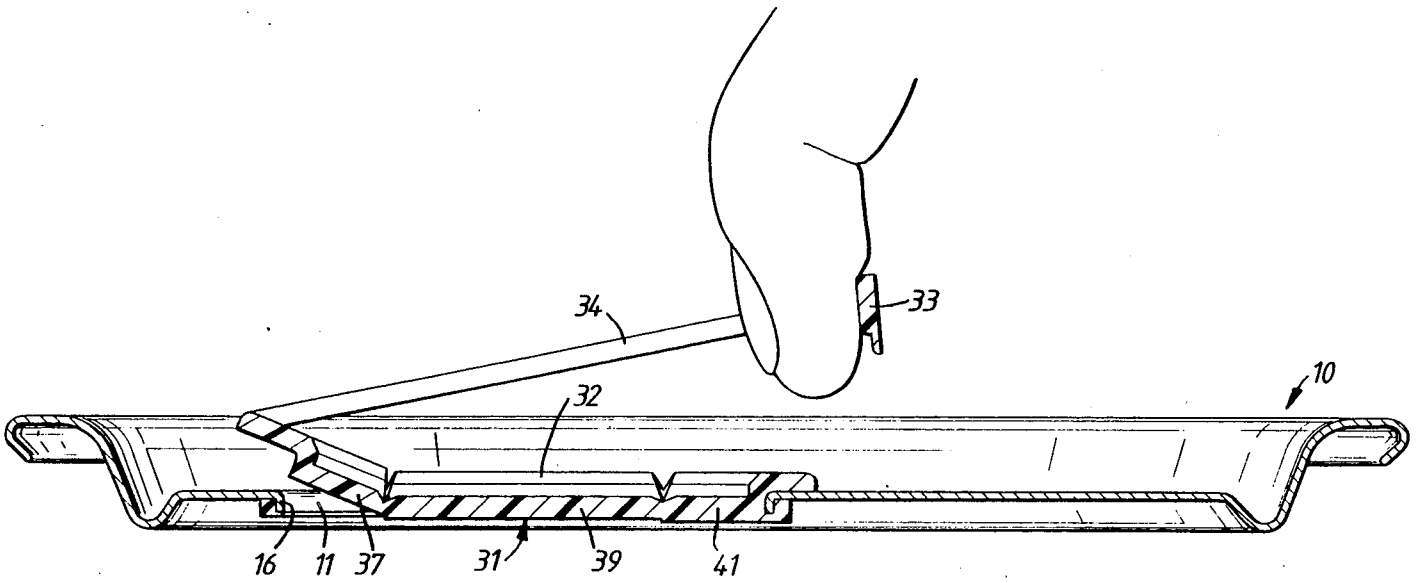
FIG. 10 is a view similar to FIG. 8 showing the first stage of opening the closure.
Figure 11:
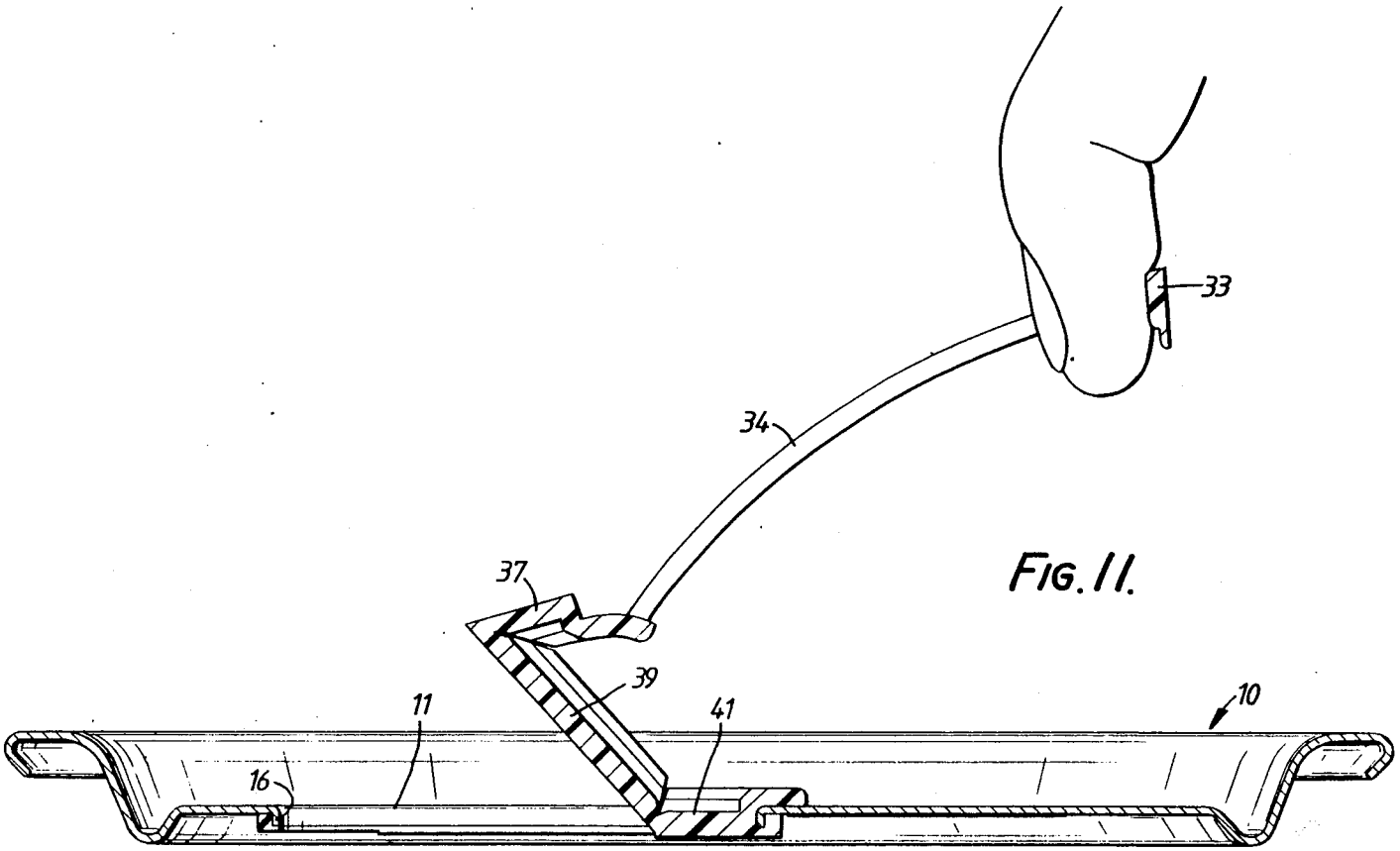
FIG. 11 is a further view similar to FIG. 8 showing the second stage of opening.

In this embodiment, a second groove 40 extends across the plug part 31 between the parallel-sided part and the rounded end portion 41 remote from the connection to the tab 33, and grooves 42,43 aligned with groove 40 extend across the rim 32, to provide a second hinge line. The residual thickness of the plastics material below the flange 16 in the rounded end 41 is greater than in the parallel sided portion and is great enough to make shearing difficult. As a result, the closure 30 can be opened through a first, venting, stage as shown in FIG. 10 and, after a temporary arrest, through a second stage as shown in FIG. 11 which opens the main portion 39, but can then be retained on the can end by aeans of the end 41 while the main portion 39 is hinged out of the way about the second hinge line to allow pouring of the contents.

I claim:

1. A metal can end with an aperture surrounded by a downturned flange formed in the metal of the can end and closed by a tear-open plastics closure, said closure having a plug part fitting into the aperture, a rim surrounding the plug part and overlying the metal of the can end around the aperture, and a laterally extending tab moulded as an integral part of the closure, the closure being moulded on to the can end so as to enclose the flange totally but to be capable of being opened by being sheared against the flange when the tab is pulled up, wherein the closure is formed with a groove extending across the plug part of the closure transversely to the length of the tab so as to form a hinge line allowing the tab and the adjacent portion of the plug part to pivot upwardly in relation to the remainder of the plug part, and the rim is reduced in thickness or interrupted in line with the groove so as not to afford substantial resistance to the hinging action, thus permitting venting of the can before full opening of the closure, and wherein the residual thickness of the plastics material below the flange is greater in the portion of the closure on the far side of the hinge line from the tab than in the portion adjacent to the tab, so as to cause a temporary arrest in the shearing action to allow time for venting before full opening of the closure.

2. A metal can end according to claim 1, wherein the plug part of the closure, at least in its portion remote from the laterally extending pull tab, has a higher resistance to bending than the metal of the can end, so that, when the can end is domed under internal pressure in the can, the said portion of the closure stiffens the part of the can end around it and the doming takes place principally in the remaining part of the can end, and the laterally extending tab accordingly extends at an angle to the adjacent surface of the can end.

3. A metal can end according to claim 1 wherein the aperture and the plug part of the closure are elongated with parallel sides and rounded ends and the tab extends laterally from one rounded end of the plug part, the groove extending across the plug part between the rounded end from which the tab extends and the parallel-sided portion of the plug part.

4. A metal can end according to claim 1 wherein the groove is of V section and of a depth substantially equal to half the thickness of the plug part of the closure.

5. A metal can end according to claim 1, wherein the tab is in the form of a pull ring and is provided with a thin fin of plastics material extending around the inside of the ring to cushion the grip for an operator's finger.

6. A metal can end according to claim 3, wherein a second groove extends transversely across the plug part between the parallel-sided portion and the rounded end remote from the connection to the tab, and the rim of the closure is reduced in thickness or interrupted in line with the second groove, to provide a second hinge line, and the residual thickness of the plastics material below the flange in the rounded end remote from the tab is greater than in the parallel-sided portion and is great enough to make shearing difficult, so that the closure can remain attached to the can end while being hinged out of the way about the second hinge line.

7. A metal can having an end according to claim 1.

* * * * *